US005992757A

United States Patent [19]

Smith et al.

[11] Patent Number: 5,992,757

[45] Date of Patent: Nov. 30, 1999

[54] SPHERICAL FOUNTAIN

[75] Inventors: William G. Smith, Rancho Palos Verdes; Henry Kopecky, Torrance, both of Calif.

[73] Assignee: Disney Enterprises, Inc., Del.

[21] Appl. No.: 09/166,607

[22] Filed: Oct. 5, 1998

[51] Int. Cl.[6] ..... B05B 17/08

[52] U.S. Cl. ..... 239/17; 239/20

[58] Field of Search ..... 239/16, 17, 20–23, 239/DIG. 7; 40/406, 407, 439; D23/201

[56] References Cited

U.S. PATENT DOCUMENTS

| | | | |
|---|---|---|---|
| D. 253,551 | 11/1979 | Roberts, Jr. | D23/201 |
| 446,897 | 2/1991 | Smith | 239/17 |
| 1,962,840 | 6/1934 | Rives | 239/17 |
| 3,088,675 | 5/1963 | Bone | 239/20 |
| 4,149,674 | 4/1979 | Fukamizu et al. | 239/20 |
| 4,715,136 | 12/1987 | Fuller et al. | 40/406 |
| 4,817,311 | 4/1989 | Ong | 40/410 |
| 4,892,250 | 1/1990 | Fuller et al. | 40/441 |

FOREIGN PATENT DOCUMENTS

| | | | |
|---|---|---|---|
| 134368 | 5/1994 | Japan | 239/23 |

*Primary Examiner*—Andres Kashnikow
*Assistant Examiner*—Lisa Ann Douglas
*Attorney, Agent, or Firm*—Medlen & Carroll, LLP

[57] ABSTRACT

A fountain having a spherical element over which water flows is disclosed. The sphere includes an upper pole, a lower pole, a polar axis connecting the upper and lower poles, an equatorial plane, and a sphere surface. The sphere is mounted in the fountain so that the upper pole forms the apex of the sphere. A water outlet is provided at the upper pole for providing a flow of water over the surface of the sphere. The surface of the sphere is provided with a plurality of annular grooves circumscribing the polar axis, and extending above and below the equatorial plane for a predetermined distance towards each pole. Each annular groove has a radius of predetermined size, with the annular grooves located on the lower hemisphere being canted downwardly and inwardly from the equatorial plane so that the water or other liquid will flow slowly, evenly and continuously downhill over the surface of the sphere from groove to groove to the lower pole, without shedding or loss beneath the equatorial plane.

20 Claims, 3 Drawing Sheets

SPHERICAL FOUNTAIN

FIELD OF THE INVENTION

The present invention relates to the field of water fountains and displays.

BACKGROUND OF THE INVENTION

Decorative fountains and water displays which are aesthetically pleasing to the eye are well known, and have been in use since ancient times. The Romans, for example, used public fountains (such as the Trevi Fountain in Rome) as a practical way of reducing incoming water pressure from aqueducts before allowing the water to flow through the urban water distribution system. Aesthetic beauty was produced almost as an afterthought.

In more recent times, fountains have been used solely for their aesthetic beauty. Typical fountains include a pump or other means for delivering water to an elevated position where the force of gravity can act upon the water, causing it to flow back to earth. The path of the water can be free-fall mode, which, in the event of high water pressure, can be very exciting. Alternatively, the flow of water can be very gentle, and a winding path over rocks and through various plants and terrains can be provided, which provides a very soothing, cooling, and natural experience. Some fountains are technologically interesting, providing an apparently seamless film of water flowing down from an elevated source.

Convex surfaces are not typically used in fountains because they provide special problems. Water flowing from the top of a sphere having a smooth surface tends to break into discrete streams and flows down towards the plane (hereinafter referred to as an "equatorial plane") which divides the sphere into an upper hemisphere and a lower hemisphere. When the water flows below the equatorial plane, the film thickness increases as a result of decreasing surface area, allowing the force of gravity to overcome the surface tension, causing the water to shed, or fall off, the surface of the sphere before it reaches the bottom.

Accordingly, the need exists for an aesthetically pleasing fountain incorporating a sphere in which the water appears to flow smoothly across the surface of the sphere from an upper to a lower pole without loss of water shedding from the surface below the equatorial plane as a result of the force of gravity.

SUMMARY OF THE INVENTION

In one embodiment, the present invention provides a fountain having a spherical component having a surface over which water can flow without shedding or falling off. The surface of the spherical component includes a plurality of annular grooves circumscribing a polar axis and extending above and below an equatorial plane for a predetermined distance towards an upper pole and/or a lower pole. Each annular groove on the upper hemisphere has a radius of predetermined size which is canted at an angle towards the center of the sphere. Each annular groove on the lower hemisphere has a radius of predetermined size which is canted at a predetermined angle downward from the equatorial plane.

In the preferred embodiment, water flows from an opening at the upper pole downward along the surface of the sphere from groove to groove towards the equatorial plane. As the water arrives at the equatorial plane, it flows downward and inward along the lower hemisphere annular grooves which are canted downward from the equatorial plane at an angle of about ten degrees. The water continues to flow from groove to groove downward towards the lower pole without any shedding of water below the equatorial plane.

In another embodiment, a series of grooves can be provided on the lower hemisphere of the sphere separated by smooth sections, which are used to speed up the flow of water, and decrease the thickness of the water film flowing over the surface of the sphere.

Other and further objects, features, advantages and embodiments of the present invention will become apparent to one skilled in the art from reading the Detailed Description of the Invention together with the drawings.

DETAILED DESCRIPTION OF THE INVENTION

Figure 1:
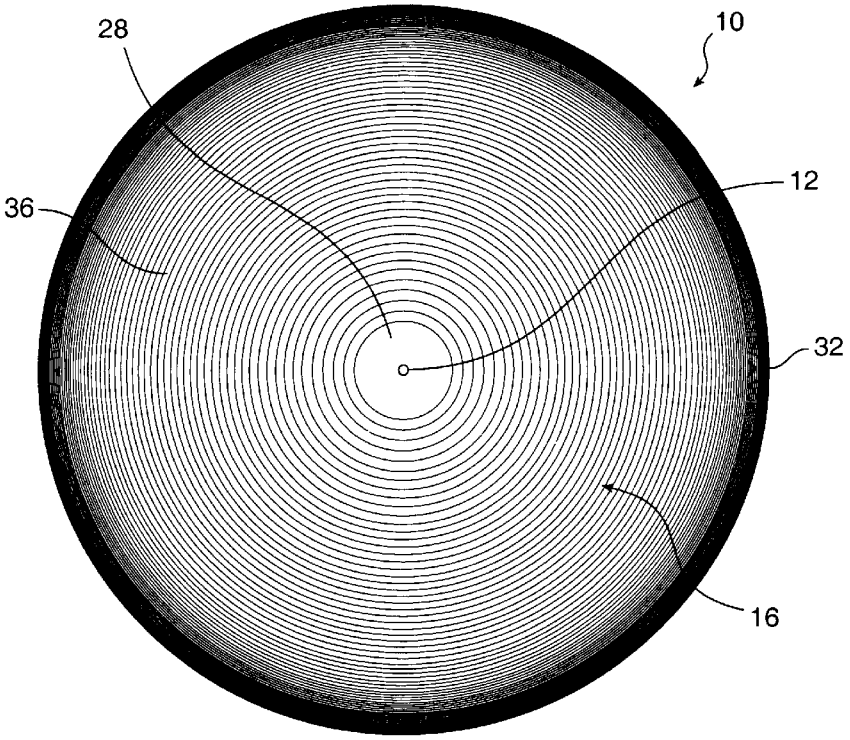
FIG. 1 is a top view of a sphere useful in a fountain of the present invention.
Figure 5:
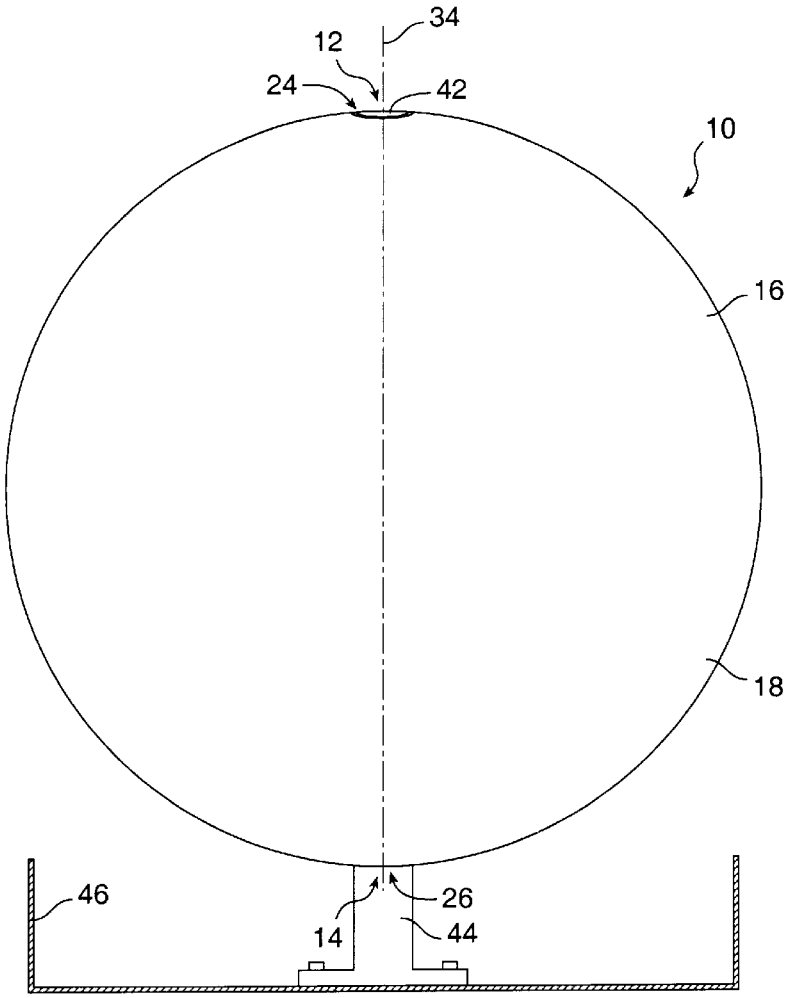
FIG. 5 is a front view of a fountain of the present invention.

As shown in FIGS. 1 and 5, a spherical fountain of the present invention includes a sphere 10 having an upper pole 12 and a lower pole 14, which are positioned along a polar axis 34, an equatorial plane passing substantially perpendicularly through polar axis 34, and a mounting pedestal 44. Sphere 10 can be formed of almost any suitably durable material which will not be adversely affected by the liquid used in the fountain. Where the liquid used is water, sphere 10 can be constructed from such materials as, for example, plastic, fiberglass, metals such as copper, aluminum or stainless steel, or glass. The kind of material used may also be determined by the size of the sphere to be constructed.

As shown in FIG. 5, the sphere 10 can be mounted to a floor or ground surface or the bottom of a pool using a mounting pedestal 44. A recirculating pool 46 may be provided to capture the water which flows down the surface of the sphere 10 to the lower pole 14. A recirculating pump (not shown) can be used to return water from the recirculating pool 46, through the interior of the sphere 10, to a water outlet 42, which may be located at or near the upper pole 12 or apex, if the apex does not coincide with upper pole 12. Alternatively, but less preferably from a water conservation standpoint, the water could simply be allowed to flow over the sphere 10 and then allowed to escape through a drain in the floor.

Sphere 10 is shown in its most preferably mounted orientation, with the upper pole 12 at the apex of the sphere. For the purposes of this invention, "apex" means the highest point on the sphere measured from the surface to which the sphere is mounted.

Figure 2:
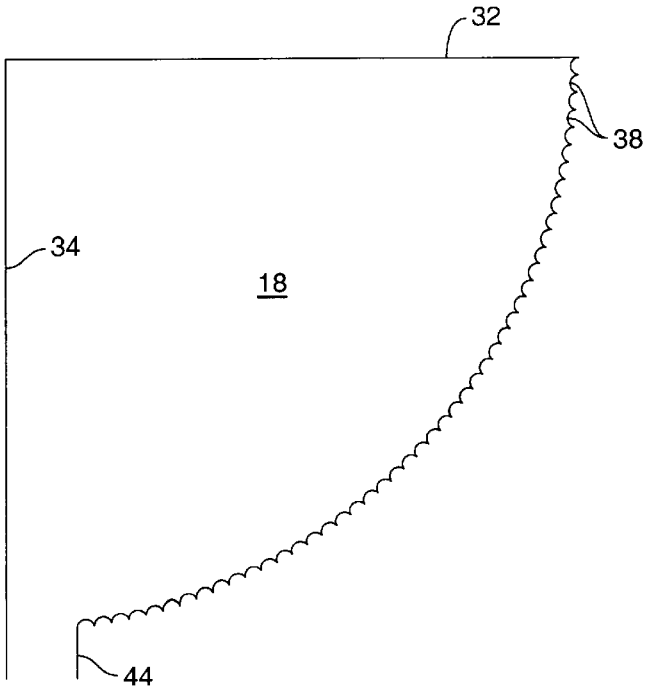
FIG. 2 is a partial, sectional view of a lower hemisphere of one embodiment of a fountain of the present invention.
Figure 3:
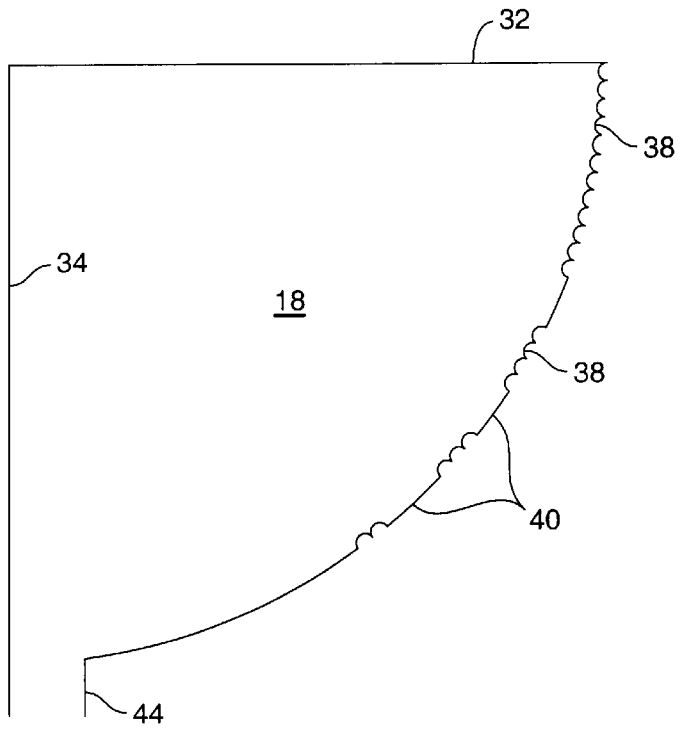
FIG. 3 is a partial, sectional view of a lower hemisphere of another embodiment of a fountain of the present invention.
Figure 4:
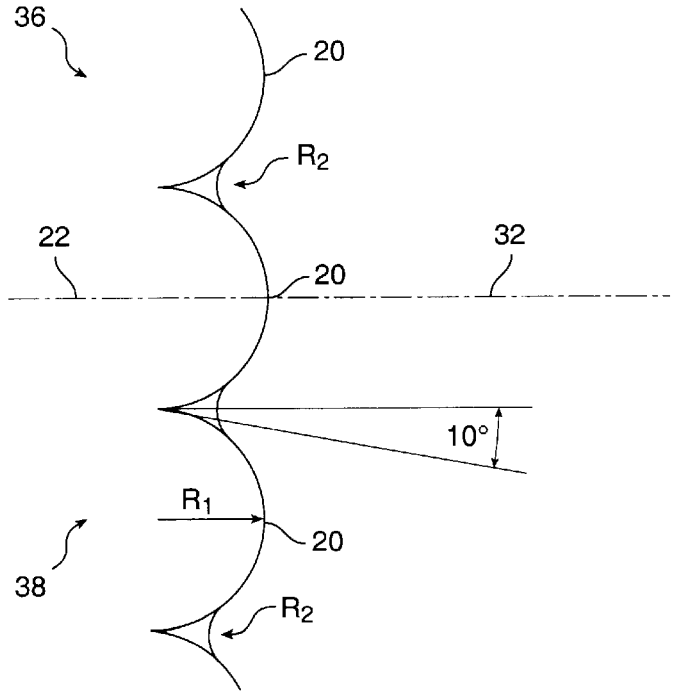
FIG. 4 is a cross-sectional view of grooves located above and below the equatorial plane of a fountain of the present invention.

As shown in FIGS. 1–4, sphere 10 is provided with a plurality of annular grooves 36 and 38 which circumscribe the polar axis. For the purposes of this invention, "circumscribe" means that, when viewed from the top (as depicted in FIG. 1), each groove forms a circle on the surface of the sphere 10 with the center for each circle located on the polar axis 34. Each annular groove 36, 38 is preferably circular in cross-section and produced with a radius of predetermined size. For the purposes of this invention, the term "radius" means the distance from the center of a circle to the circumference of that circle. Thus, when determining the radius of any annular groove 36, 38, taken in cross-section as shown in FIG. 4, the center is located on the surface of the sphere, and the circumference is formed in part by the walls of that groove 36, 38.

In the preferred embodiment of the present invention, the sphere 10 is divided into two segments: an upper hemisphere 16 located between the top pole 12 and the equatorial plane 32, and a lower hemisphere 18 located between the equatorial plane 32 and the bottom pole 14.

As shown in FIGS. 1 and 4, the upper hemisphere grooves 36 are most preferably semi-circular in cross-section and generated through the center of the sphere (i.e., a bisecting radius 22 from the center of the sphere passes through the base 20, bisecting the walls of each groove 36). In this most preferred embodiment, the groove has a radius of approximately 0.125 inches. However, other groove sizes and configurations, such as, for example, grooves having a radius from about 0.031 inches to about 0.187 inches will also work.

As shown in FIGS. 2 and 4, to prevent substantial shedding of water as it crossed the equatorial plane 32 and travels over the surface of the lower hemisphere 18, we cant the annular grooves away from the equatorial plane (i.e, downwardly and inwardly), most preferably at an angle of about 10 degrees. This is most preferred because, if the grooves are simply aligned to the center of the sphere as described above for the upper hemisphere grooves, high spots are created between the grooves which requires that water must flow uphill, an impossibility in a gravity dependent flow system with low cohesive forces. Below the equatorial plane, gravity will overcome the surface tension and cause water to flow downward and inward. By canting the annular grooves downwardly and inwardly, the water flows always downhill along the ten degree slope effectively provided by canting the annular grooves ten degrees in a direction downward from the equatorial plane 32. This allows the surface tension to exceed the force of gravity on the water, thereby allowing it to flow down the entire surface of the sphere from groove to groove to the lower apex. In addition, we have found that this arrangement also produces a very distinctive and pleasing shimmering effect which gives the water a cloud-like appearance. As with the upper hemisphere grooves 36, grooves 38 are most preferably semi-circular in cross-section and also preferably have a radius (R1) of about 0.125 inches. Radius R2, shown in FIG. 4, formed between the intersection of adjacent grooves, is preferably about 0.062 inches. As noted above, other shapes and sizes will produce a similar effect. For example, we have found lower hemisphere grooves 38 having a depth of 0.166 inches and a wall-to-wall dimension at the surface of the sphere of 0.500 inches, or a depth of 0.5 inches and a wall-to-wall dimension at the surface of the sphere of 0.250 inches will also function to prevent water from shedding off the surface of the lower hemisphere.

In a less preferred embodiment, shown in FIG. 3, several groups containing a plurality of grooves 38 are provided on the surface of the lower hemisphere, each group being separated from an adjacent group by a smooth annular region 40. The size of the smooth annular region should be relatively small near the equatorial plane, but may increase in size as the bottom pole is approached. The purpose of such smooth sections is to increase the flow of water over the surface of the sphere, thereby thinning the water film and inducing prolonged attachment.

With regard to the radius of the grooves, the size of the sphere does not appear to control groove size or radius at cusps. The sphere can vary significantly in size (for example, from 10 inches to 30 feet—or larger) without necessitating a change in the size of the grooves.

Figure 6:
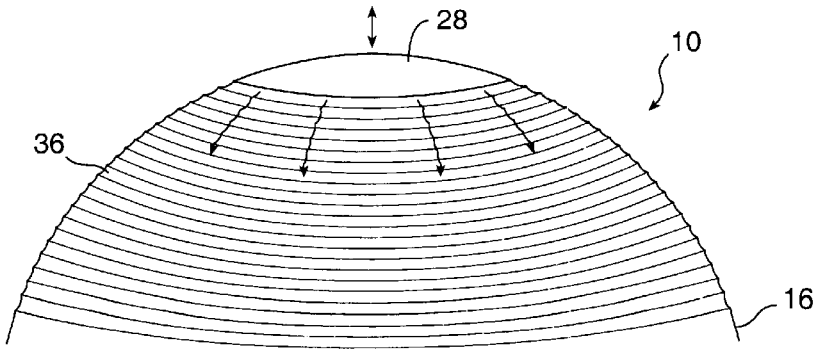
FIG. 6 is a partial side view of an upper hemisphere of a fountain of the present invention.

As shown in FIGS. 1 and 5–6, an opening 24 is provided at the top pole 12 for a liquid outlet 42. A polar cap 28 can be mounted over opening 24 for movement towards and away from opening 24 in order to adjust the flow of liquid from opening 24. In this embodiment, water flows from the space between liquid outlet 42 and cap 28.

An opening 26 can be similarly provided in the region of the bottom pole 14 to permit a support structure to extend through the bottom of the sphere 10 and into the interior of the sphere 10 to provide an inlet for plumbing arid space for securing or mounting the sphere 10 to a floor surface or pool bottom.

Liquid flow rates will vary with the size of the sphere 10. For example, we have found that good results are obtained with a 45" diameter sphere when a flow rate of from about 2 gal per minute to about 8 gal per minute are used. We predict that a 320 inch sphere will require about 40 to about 100 gallons per minute to achieve good results.

One skilled in the art will recognize at once that it would be possible to construct the present invention from a variety of materials and in a variety of different ways. For example, while the preferred invention is described as using water, it is evident that other liquids could also be used in a fountain of the present invention. Likewise, while the preferred embodiment has been described in terms of a sphere, it should be evident that these teachings can also be applied to portions of a sphere, such as, for example, an upper or a lower hemisphere. While the preferred embodiments have been described in detail, and shown in the accompanying drawings, it will be evident that various further modification are possible without departing from the scope of the invention as set forth in the appended claims.

What is claimed is:

1. A fountain having a spherical component, comprising:

a sphere having an upper pole, a lower pole, a polar axis connecting said upper and lower poles, an equatorial plane, an upper hemisphere positioned between said upper pole and said equatorial plane, and a lower hemisphere positioned between said equatorial plane and said lower pole, and a sphere surface, said sphere positioned so that the upper pole forms an apex; and, a means for allowing liquid to flow over the surface of said sphere without substantial shedding of said liquid from said sphere surface between said equatorial plane and said lower pole.

2. The fountain of claim 1 additionally comprising a means for delivering said liquid to an upper portion of said sphere surface.

3. The fountain of claim 1 wherein said means for causing liquid to flow over said sphere surface without substantial shedding of said liquid comprises a plurality of annular grooves, each annular groove circumscribing said polar axis.

4. The fountain of claim 3 wherein said sphere surface of said lower hemisphere is provided with a plurality of groups of annular grooves, each said group of annular grooves being separated from an adjacent group of annular grooves by a smooth surfaced region.

5. The fountain of claim 3 wherein said annular grooves of said upper hemisphere and said lower hemisphere all have the same predetermined radius.

6. The fountain of claim 5 wherein said predetermined radius is approximately 0.125 inches.

7. The fountain of claim 3 wherein said annular grooves of said lower hemisphere are canted away from said equatorial plane.

8. The fountain of claim 7 wherein each said annular groove located on said lower hemisphere is canted at an angle of approximately ten (10) degrees.

9. The fountain of claim 1 wherein said sphere is approximately 8 meters in diameter.

10. The fountain of claim 1 wherein said liquid is water.

11. The fountain of claim 1 additionally comprising a means for controlling the rate of water flow from the upper pole, across the surface of the sphere, and down to the lower pole.

12. The fountain of claim 1 additionally including a means for mounting the sphere to a floor or pool surface.

13. A fountain including a spherical component, comprising:

a sphere having an upper pole, a lower pole, a polar axis connecting said upper and lower poles, an equatorial plane, an upper hemisphere located between said upper pole and said equatorial plane, a lower hemisphere located between said equatorial plane and said lower pole, and a sphere surface;

a means for mounting said sphere whereby said upper pole forms an apex;

a means for introducing a liquid to the surface of said sphere at said upper pole;

said sphere surface including a plurality of annular grooves circumscribing said polar axis and extending above and below said equatorial plane for a predetermined distance towards each pole.

14. The spherical fountain of claim 13 wherein each said annular groove has a predetermined radius.

15. The spherical fountain of claim 14 wherein said predetermined radius is about 0.125 inches.

16. The spherical fountain of claim 13 wherein said annular grooves located on said lower hemisphere are canted away from said equatorial plane by about ten degrees.

17. The spherical fountain of claim 13 wherein said liquid is water.

18. A fountain including at least a portion of a sphere having a surface, an upper pole, a lower pole, a polar axis connecting said upper and lower poles, an equatorial plane, an upper hemisphere located between said upper pole and said equatorial plane, and a lower hemisphere located between said equatorial plane and said lower pole, said fountain comprising:

a portion of a sphere mounted so that the equatorial plane is positioned above the lower pole;

a plurality of grooves in the surface of the sphere circumscribing said polar axis and extending from the equatorial plane for a predetermined distance towards the lower pole, each said annular groove having a predetermined radius and canted downwardly and inwardly from said equatorial plane.

19. The fountain of claim 18 wherein said annular grooves are canted at an angle of about ten (10) degrees away downwardly and inwardly from said equatorial plane.

20. The fountain of claim 17 additionally including a water outlet positioned above the equatorial plane for flowing liquid by gravity over substantially the entire surface of the sphere from the equatorial plane to the lower pole.

* * * * *